United States Patent [19]

Rosenberg

[11] Patent Number: 4,819,872

[45] Date of Patent: Apr. 11, 1989

[54] LIQUID DISPENSING DEVICE AND WATER SPRINKLER INCLUDING SAME

[76] Inventor: Peretz Rosenberg, Moshav Beit Shearim, Israel

[21] Appl. No.: 60,177

[22] Filed: Jun. 10, 1987

[30] Foreign Application Priority Data

Jul. 1, 1986 [IL] Israel ..... 79296
Jan. 5, 1987 [IL] Israel ..... 81170

[51] Int. Cl.[4] ..... B05B 15/02

[52] U.S. Cl. ..... 239/119; 239/222.17; 239/396; 239/581.1; 251/207

[58] Field of Search ..... 239/119, 222.17, 390, 239/391, 396, 581.1; 251/206, 207

[56] References Cited

U.S. PATENT DOCUMENTS

| | | | |
|---|---|---|---|
| 915,694 | 3/1909 | Pendergrass | 239/396 |
| 1,128,445 | 2/1915 | Henning | 251/207 |
| 1,273,349 | 7/1918 | Filbin | 239/581.1 |
| 1,412,468 | 4/1922 | Jeanmaire | 239/581.1 |
| 4,116,386 | 9/1978 | Calder | 239/119 |
| 4,206,877 | 6/1980 | Hoza, III | 239/581.1 |
| 4,391,265 | 7/1983 | Chen | 251/207 |
| 4,483,481 | 11/1984 | Calder | 239/119 |
| 4,560,108 | 12/1985 | Rubinstein | 239/222.17 |

FOREIGN PATENT DOCUMENTS

| | | | |
|---|---|---|---|
| 742662 | 7/1980 | U.S.S.R. | 251/207 |
| 923635 | 4/1982 | U.S.S.R. | 239/396 |
| 1071 | of 1869 | United Kingdom | 239/396 |

*Primary Examiner*—Andres Kashnikow
*Assistant Examiner*—Michael J. Forman
*Attorney, Agent, or Firm*—Benjamin J. Barish

[57] ABSTRACT

A liquid dispensing device comprises a body member connectable to a source of pressurized liquid and a nozzle carried by the body member and having an inlet communicating with the source of pressurized liquid, and an outlet orifice for discharging the pressurized liquid in the form of a jet. The nozzle is rotatably mounted in the body member to either an operative position wherein its inlet faces the source of pressurized liquid for discharging the pressurized liquid through its outlet orifice, or to a self-cleaning position wherein its outlet orifice faces the source of pressurized liquid for flushing out clogging particles through the nozzle inlet. The nozzle includes two sections, one of which is presettable to a plurality of different positions to define with the other section a plurality of outlet orifices of different cross-sectional areas.

14 Claims, 2 Drawing Sheets

LIQUID DISPENSING DEVICE AND WATER SPRINKLER INCLUDING SAME

BACKGROUND OF THE INVENTION

The present invention relates to liquid dispensing devices particularly useful in water sprinklers. While the liquid dispensing device of the present application may have other uses, it is intended primarily for use as a water sprinkler, and is therefore described below with respect to this application.

A large number of different types of water sprinklers are now in use for irrigating crops. Such sprinklers are commonly used with poor grades of irrigating water which contain a relatively high quantity of dirt or other foreign particles tending to clog the sprinkler. In most sprinklers, cleaning them of clogging particles requires the sprinkler at least to be partially disassembled in order to provide access to the clogged parts, which may then be flushed or otherwise cleaned. However, disassembling the sprinkler and reassembling it is both time-consuming and labor-consuming.

In addition, most sprinklers are designed for one particular output, so that changing the output for a particular application usually requires replacing the sprinkler for another one of the desired output.

An object of the present invention is to provide a flow dispensing device, and particularly a water sprinkler, having advantages in the above respects.

BRIEF SUMMARY OF THE INVENTION

According to one aspect of the present invention, there is provided a liquid dispensing device comprising a body member having an inlet end connectable to a source of pressurized liquid, and a nozzle carried by the body member and having an inlet communicating with the source of pressurized liquid, and an outlet throat for discharging the pressurized liquid therethrough in the form of a jet; characterized in that the nozzle is rotatably mounted in the body member from an operative position wherein its inlet faces said source of pressurized liquid for discharging the pressurized liquid through its outlet throat, to a self-cleaning position wherein its outlet orifice faces said source of pressurized fluid for flushing out clogging particles through the nozzle inlet. The nozzle inlet has a cross-sectional area of conical configuration decreasing in diameter from the inlet end of the body member to the outlet throat. The nozzle is split along a plane extending parallel to the jet discharged therefrom to define a first section and a second section. The first section is formed with a partial bore constituting a part of the cross-sectional area of the nozzle inlet and the nozzle throat. The second section is presettable to a plurality of different positions with respect to the first section and is formed with a complementary partial bore having recessess of different cross-sectional areas facing the partial bore of the first section and cooperable therewith to define a plurality of outlet throats of different cross-sectional areas according to the preset position of the second section with respect to the first section.

The invention is particularly useful in a rotary sprinkler, wherein a rotary distributor is rotatably mounted to the body member in alignment with the jet discharged from the nozzle and includes channel means for receiving the jet discharged from the nozzle for rotating the rotary distributor and for deflecting the jet laterally of the device.

According to a further important feature in this embodiment, the recesses of different cross-sectional areas are arranged in a circular array around the rotary axis of the second section so as to be alignable with the partial bore of the first section, to preset the total cross-sectional area of the outlet throat according to the preset position of the second section.

According to a still further important feature, the two nozzle sections together are of cylindrical configuration so as to be rotatable about their longitudinal axes, each section being removably received within a bore formed in the body member permitting its removal from the side for repair or replacement purposes.

As will be clearly apparent from the description below, liquid dispensing devices in general, and water sprinklers in particular, constructed in accordance with the foregoing features provide a number of important advantages. Thus, the nozzle may be easily and quickly cleaned of clogging particles by merely rotating the nozzle from its normal operative position to its self-cleaning position wherein its outlet orifice faces the source of pressurized fluid, whereupon the clogging particles would be flushed out throught the nozzle inlet. Disassembling this sprinkler for cleaning it, and then reassembling it, are thereby obviated, saving the user considerable time and labor. In addition, the dispensing device, or water sprinkler, may be easily and quickly converted to one having a different output by merely presetting the second nozzle section to a selected position with respect to the first nozzle section, or by removing the cylindrical nozzle from the side and inserting another cylindrical nozzle having the desired output. Not only does this save the user considerable time and labor, but also substantially reduces the inventory required since only a stock of different-size nozzles need be maintainted in the inventory.

Further features and advantages of the invention will be apparent from the discription below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
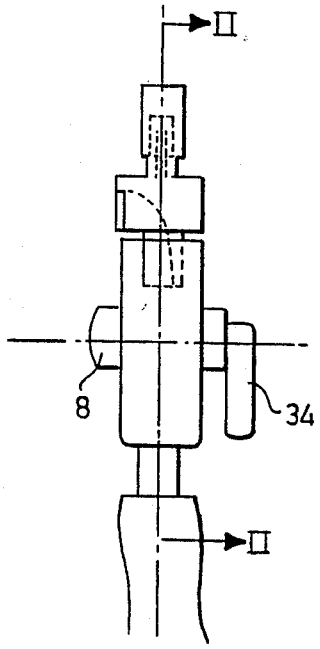
FIG. 1 is a side elevational view illustrating one form of water sprinkler constructed in accordance with the present invention.
Figure 2:
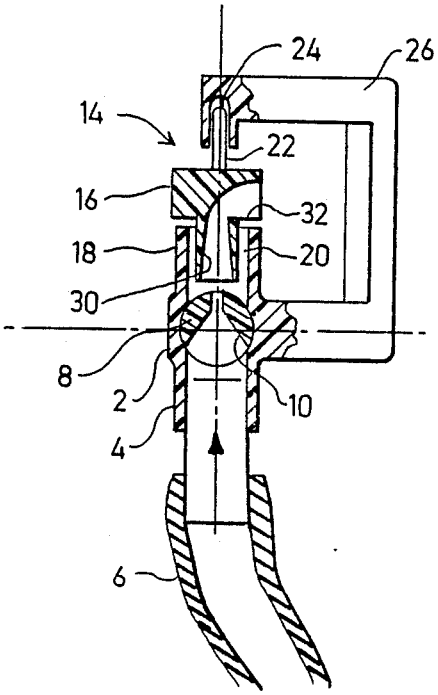
FIG. 2 is a longitudinal sectional view along line II—II of FIG. 1.

The water sprinkler illustrated in FIGS. 1 and 2 comprises a body member or sprinkler head 2 of generally cylindrical construction and having an inlet end 4 connectable to a source of pressurized liquid via a tube 6. A nozzle 8 is disposed within the sprinkler head 2 and has an inlet end 10 normally facing the inlet end 4 of the sprinkler head, and an outlet throat 12 for discharging the water in the form of a jet. Inlet end 10 of nozzle 8 is of conical configuration, decreasing in diameter from the inlet end of the nozzle to its outlet orifice 12 through which the water is discharged in the form of a jet.

The illustrated sprinkler further includes a distributor 14 located to receive the jet from the nozzle outlet throat 12 and to distribute the water laterally around the sprinkler head 2. Distributor 14 includes a rotor 16 formed with a stem 18 at its lower end receivable within a socket 20 in the sprinkler head 2, and another stem 22 at its opposite end receivable within a socket 24 formed in arm 26 of a bridge 28 integrally formed with, or otherwise secured to, the sprinkler head 2. Rotor stem 18 is formed with an axially-extending groove 30 merging with a curved radially extending groove 32 formed in the under face of the rotor 14. The axially-extending groove 30 is aligned with the outlet throat 12 of nozzle 8 so as to receive the axial jet discharged from that throat and to guide the jet to groove 32 formed in the underface of rotor 14 which deflects the jet laterally of the sprinkler head. The jet rotates rotor 14 which thereby distributes the water laterally around the sprinkler head.

Nozzle 8 in the sprinkler head 2 is of cylindrical configuration and is received within a cylindrical bore 33 formed through the sprinkler head. The ends of nozzle 8 project through the bore so as to extend laterally past the opposite faces of the sprinkler head 2, as clearly shown in FIG. 1. One projecting end of nozzle 8 carries a manipulatable member in the form of a handle 34 extending externally of the sprinkler head so as to be accessible to the user. Handle 34 may thus be conveniently used to rotate the nozzle 8 to either the position illustrated in FIG. 3*a*, wherein the conical inlet end 10 of the nozzle faces the inlet end 4 of the sprinkler head, or to the position illustrated in FIG. 3*b*, wherein the outlet throat 12 of the nozzle faces the inlet end 4 of the sprinkler head.

Figure 3A:
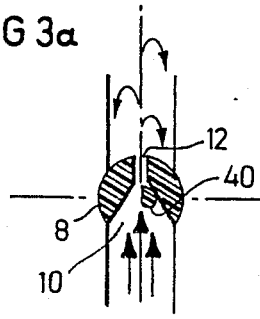
FIG. 3*a* is a fragmentary view illustrating the nozzle of the sprinkler of FIGS. 1 and 2 in its normal operative position but clogged by a foreign particle in the irrigating water.

The nozzle position illustrated in FIG. 3*a* is the normal operative position of the nozzle. In this position the water from supply tube 6 is directed by the conical inlet end 10 of the nozzle to the outlet throat 12 where the water exits in the form a jet into the axially-extending groove 30 formed in the rotor stem 18. The jet is then deflected laterally of the sprinkler head by groove 32 formed in the underface of rotor 14, thereby rotating the rotor to distribute the water laterally around the sprinkler head.

Figure 3B:
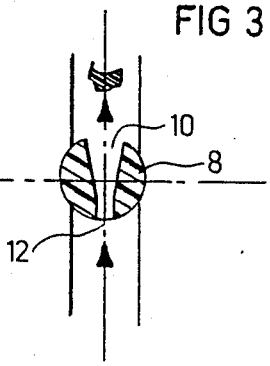
FIG. 3*b* is a view similar to that of FIG. 3*a* but illustrating the nozzle after it has been rotated 180 degrees to its self-cleaning position in order to flush out the clogging particle through the nozzle inlet.
Figure 4:
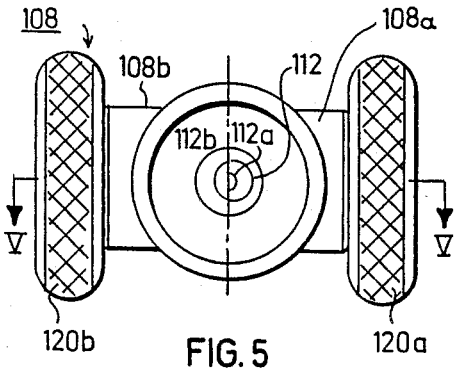
FIG. 4 is an enlarged, top plan view illustrating a modified construction of a presettable-rate nozzle for use in the sprinkler of FIGS. 1 and 2.

Should a clogging particle, as indicated by particle 40 in FIG. 3*a*, enter the nozzle and clog it, the nozzle may be rotated 180 degrees to the self-cleaning position illustrated in FIG. 3*b*. As is clear from FIG. 3*a*, the clogging particle 40 will be trapped at the juncture of the throat 12 and its conical section 10. In the rotated position of FIG. 3*b*, the outlet throat 12 of the nozzle now faces the inlet end 4 of the sprinkler head, so that the pressurized water introduced into the sprinkler head via supply pipe 6 flushes out the clogging particle 40 through the nozzle inlet 10.

Thus, for normal operation of the sprinkler, the nozzle 8 would be in the position illustrated in FIG. 3*a*, but whenever the nozzle may become clogged by solid particles in the water, the clogging particles may be easily and quickly flushed out by merely manipulating handle 34 to rotate the nozzle to its FIG. 3*b* position. Once the clogging particles have been flushed out, the nozzle may then be rotated to its normal operative position illustrated in FIG. 3*a* by merely manipulating handle 34 back to its normal position.

Should it be desired to remove nozzle 8 for repair or replacement purposes, this may be easily done by merely pushing it out from its cylindrical bore 33 in the sprinkler head 2. The nozzle, after repaired, or another replacement nozzle, may then be reintroduced from the side by merely inserting it into the cylindrical bore 33 of the sprinkler head.

It will thus be seen that the nozzle 8 in the sprinkler head 2 may be easily and simply cleaned of clogging particles by merely rotating it from its FIG. 3*a* position to its 3b position to flush the clogging particles out of its outlet throat 12, without disassembling the sprinkler, thereby providing substantial savings in time for cleaning the sprinkler head. It will also be appreciated that the nozzle may be conveniently removed for repair or replacement purposes by merely pushing it out of its cylindrical bore, without requiring any further disassembly of the sprinkler head, thereby also providing substantial savings in time for repairing the sprinkler head. In addition, the sprinkler may be conveniently converted from one rate to another by merely removing its nozzle 8 from the side and reintroducing another nozzle of the desired rate, thereby providing substantial saving in the inventory of sprinklers and parts required by the user.

FIGS. 4–9 illustrate another construction which permits the nozzle output rate to be changed, as desired, without replacing it or without even removing it from the sprinkler. This advantage of variable output rate is provided in addition to all the other advantages described above with respect to the sprinkler of FIGS. 1 and 2.

Thus, the nozzle illustrated in FIGS. 4–9, therein generally designated 108, is split along a plane extending parallel to the jet discharged from the nozzle, so as to define two sections, 108*a* and 108*b* each of cylindrical shape and received within a bore formed in the body member 102, namely the sprinkler head when the invention is embodied in a sprinkler. Body member 102 includes an inlet end 104 connectable to a source of pressurized liquid. Nozzle 108 has an inlet end normally facing the inlet end 104 of the sprinkler head. Nozzle 108 further includes an outlet throat, generally designated 112 in FIGS. 4 and 5, for discharging the water in the form of a jet against the distributor (14, FIG. 2) which distributes the water laterally around the sprinkler head as described above with respect to FIGS. 1 and 2.

Figure 7:
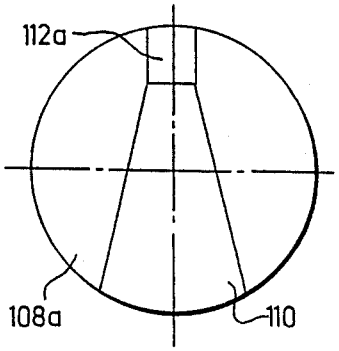
FIG. 7 is a top plan view, of one section in the nozzle of FIGS. 4 and 5.
Figure 8:
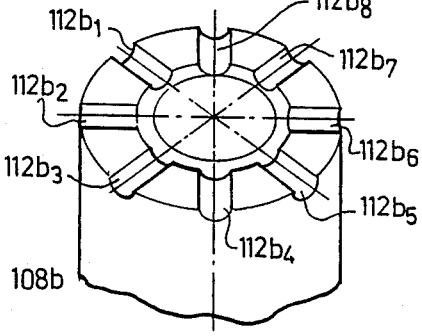
FIG. 8 is a three-dimensional view.
Figure 9:
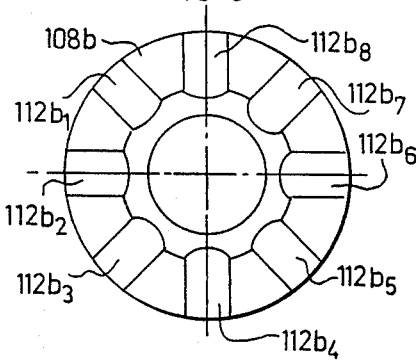
FIG. 9 is a top plan view, illustrating the other section of the nozzle in FIGS. 4 and 5.

In the nozzle construction illustrated in FIGS. 4–9, the outlet throat 112 is constituted of two partial bores, namely a semi-cylindrical recess defining a partial bore 112*a* formed in nozzle section 108*a*, and a semi-cylindrical recess defining a partial bore 112*b* formed in nozzle section 108*b*. Nozzle section 108*a* is formed with a single partial bore 112*a*, as shown particularly in FIG. 6 and 7; whereas nozzle section 108*b* is formed with a plurality of partial bores 112$b_1$–112$b_7$ as shown in FIGS. 8 and 9. The latter partial bores are selectively alignable with partial bore 112*a* in order to preset the total cross-sectional area of the outlet throat 112 as desired.

Figure 6:
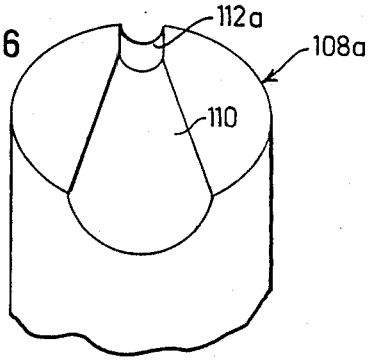
FIG. 6 is a three-dimensional view.

More particularly, as shown in FIGS. 6 and 7, nozzle section 108*a* is formed with partial, semi-cylindrical bore 112*a* at one side, and with a partial, semi-conical bore 110, corresponding to conical bore 10 FIG. 2, on the opposite side. Nozzle section 108*b*, however, as shown particularly in FIG. 9, is formed with a plurality of partial, semi-cylindrical bores 112$b_1$–112$b_7$ arranged in a circular array around the rotary axis of nozzle section 108*b* so that nozzle section 108*b* may be rotated to align any one of its partial bores with partial bore 112*a* to produce an outlet throat of any desired cross-sectional area.

To facilitate rotation of the two nozzle sections 108*a*, 108*b*, each is formed with a manipulatable knob 120*a*, 120*b* projecting through body member 102.

Figure 5:
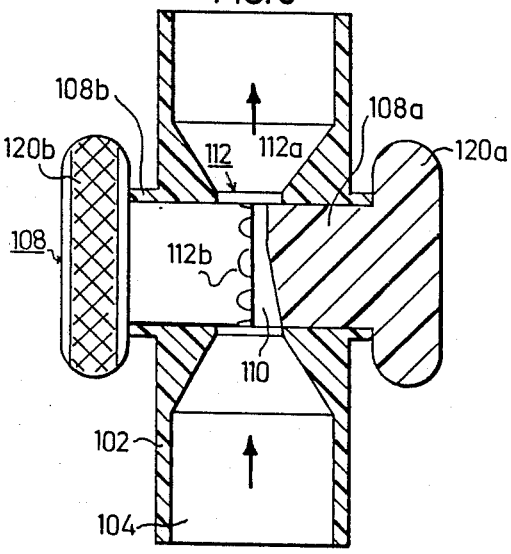
FIG. 5 is a sectional view along line V—V of FIG. 4.

It will be seen that the nozzle illustrated in FIGS. 4–9 may be used in the same manner as described above with respect to FIGS. 1 and 2. Preferably, both nozzle sections 108*a* and 108*b* are together rotated either to their operative positions as illustrated in FIG. 5 for outputting the jets through outlet throat 112, or to their self-cleaning positions wherein their two partial, semi-cylindrical bores 112*a*, 112*b* defining the outlet throat, face the inlet end 104 of the body member so that clogging particle are discharged through the semi-conical bore 110. The nozzle construction illustrated in FIGS. 4–9, however, provides the additional advantage that when the nozzle is in its operative position, its output can be preset as desired by merely rotating nozzle section 108*b* about its longitudinal axis to align a selected one of its partial semi-cylindrical bores 112$b_1$–112$b_7$ with partial semi-cylindrical bore 112*a* of nozzle section 108*a*.

While the invention has been described with respect to sprinkler heads of the rotor-type distributor, it will be appreciated that these embodiments are set forth purely for purposes of example, and that many other variations, modifications and applications of the invention may be made.

I claim:

1. A liquid dispensing device, comprising a body member having an inlet end connectable to a source of pressurized liquid and a nozzle carried by said body member and having an inlet communicating with said source of pressurized liquid, and an outlet throat for discharging the pressurized liquid therethrough in the form of a jet; said nozzle being rotatably mounted in said body member from an operative position wherein its inlet faces said source of pressurized liquid for discharging the pressurized liquid through its outlet throat, to a self-cleaning position wherein its outlet throat faces said source of pressurized liquid for flushing out clogging particles through the nozzle inlet; said nozzle inlet having a cross-sectional area of conical configuration decreasing in diameter from the inlet end of the body member to the outlet throat; said nozzle being split along a plane extending parallel to the jet discharged therefrom to define a first section and a second section; said first section being formed with a partial bore constituting a part of the cross- sectional area of said nozzle inlet and said nozzle throat; said second section being presettable to a plurality of different positions with respect to said first section and being formed with a complementary partial bore having recesses of differnt cross-sectional areas facing the partial bore of the first section and cooperable therewith to define a plurality of outlet throats of different cross-sectional areas according to the preset position of said second section with respect to said first section.

2. The device according to claim 1, further including a rotary distributor rotatably mounted to said body member in alignment with the jet discharged from the nozzle and including channel means for receiving the jet discharged from the nozzle for rotating the rotary distributor and for deflecting the jet laterally of the device.

3. The device according to claim 1, wherein said second section of the nozzle is rotatably mounted with respect to said first section so as to be presettable to a plurality of different rotary positions with respect to said first section.

4. The device according to claim 3, wherein said recesses of different cross-sectional areas are arranged in a circular array around the rotary axis of the second section so as to be alignable with said partial bore of said first section, to preset the total cross-sectional area of the outlet throat according to the preset position of said second section.

5. The device according to claim 4, wherein the two nozzle sections together are of cylindrical configuration so as to be rotatable about their longitudinal axes, each section being removably received within a bore formed in the body member permitting its removal from the side for repair or replacement purposes.

6. A liquid dispensing device, comprising a body member having an inlet end connectable to a source of pressurized liquid and a nozzle carried by said body member and having an inlet communicating with said source of pressurized liquid, and an outlet throat for discharging the pressurized liquid therethrough in the form of a jet; said nozzle being split along a plane extending parallel to the jet discharged therefrom to define a first section and a second section; said first section being formed with a partial bore constituting a part of the cross-sectional area of said outlet nozzle inlet and said nozzle throat; said second section being presettable to a plurality of different positions with respect to said first section and being formed with a complementary partial bore having recesses of different cross-sectional areas facing the partial bore of the first section and cooperable therewith to define a plurality of outlet throats of different cross-sectional areas according to the preset position of said second section with respect to said first section.

7. The fluid dispensing device according to claim 6, wherein said second section of the nozzle is rotatably mounted with respect to said first section so as to be presettable to a plurality of different rotary positions with respect to said first section.

8. The fluid dispensing device according to claim 7, wherein said recesses of different cross-sectional areas are arranged in a circular array around the rotary axis of the second section so as to be alignable with said partial bore of said first section, to preset the total cross-sectional area of the outlet throat according to the preset position of said second section.

9. The fluid dispensing device according to claim 8, wherein the two nozzle sections together are of cylindrical configuration so as to be rotatable about their longitudinal axes, each section being removably received within a bore formed in the body member permitting its removal from the side for repair or replacement purposes.

10. The device according to claim 6, wherein said nozzle is rotatably mounted in said body member from an operative position wherein its inlet faces said source of pressurized liquid for discharging the pressurized liquid through its outlet throat, to a self-cleaning position wherein its outlet throat faces said source of pressured liquid for flushing out clogging particles through the nozzle inlet; said nozzle inlet having a cross-sectional area of conical configuration decreasing in diameter from the inlet end of the body member to the outlet throat; said outlet throat having a length sufficient to prevent clogging particles in the water from penetrating completely therethrough where they may interfere with said rotation of the nozzle.

11. The device according to claim 10, wherein said nozzle includes a manipulatable member projecting through said body member to facilitate rotating it to either its operative or self-cleaning position.

12. The device according to claim 10, wherein said nozzle is of cylindrical configuration and is rotatable about its longitudinal axis.

13. The device according to claim 12, wherein said cylindrical nozzle is removably received within a cylindrical bore formed in said body member, permitting its removal from the side for repair or replacement purposes.

14. A water sprinkler including a fluid dispensing device according to claim 6, and a rotary distributor rotatably mounted to said body member in alignment with the jet discharged from the nozzle and including channel means for receiving the jet discharged from the nozzle for rotating the rotary distributor and for deflecting the jet laterally of the sprinkler.

* * * * *